US012465965B2

(12) United States Patent
Wendt et al.

(10) Patent No.: US 12,465,965 B2
(45) Date of Patent: Nov. 11, 2025

(54) INTERMEDIATE STAND GUIDE ON A VERTICAL ROLL STAND OF A MILL TRAIN, AND METHOD FOR GUIDING THE ROLLED STOCK USING THE INTERMEDIATE STAND GUIDE

(71) Applicant: SMS GROUP GMBH, Düsseldorf (DE)

(72) Inventors: Stefan Wendt, Hilchenbach (DE); Ron Beuter, Kreuztal (DE)

(73) Assignee: SMS GROUP GMBH, Düsseldorf (DE)

( * ) Notice: Subject to any disclaimer, the term of this patent is extended or adjusted under 35 U.S.C. 154(b) by 418 days.

(21) Appl. No.: 17/760,587

(22) PCT Filed: Aug. 31, 2020

(86) PCT No.: PCT/EP2020/074222
§ 371 (c)(1),
(2) Date: Mar. 15, 2022

(87) PCT Pub. No.: WO2021/052738
PCT Pub. Date: Mar. 25, 2021

(65) Prior Publication Data

US 2022/0339687 A1 Oct. 27, 2022
US 2023/0093771 A2 Mar. 23, 2023

(30) Foreign Application Priority Data

Sep. 19, 2019 (DE) ..... 102019214290.7
May 19, 2020 (DE) ..... 102020206297.8

(51) Int. Cl.
*B21B 39/16* (2006.01)
*B21B 13/06* (2006.01)

(52) U.S. Cl.
CPC ..... *B21B 39/16* (2013.01); *B21B 13/06* (2013.01)

(58) Field of Classification Search
CPC ..... B21B 13/06; B21B 31/32; B21B 39/16; B21B 39/165; B21B 39/02; B21B 39/12
See application file for complete search history.

(56) References Cited

U.S. PATENT DOCUMENTS 2,072,121 A * 3/1937 Montgomery ..... B21B 39/14 72/235
2,962,917 A * 12/1960 Drysdale ..... B21B 39/14 72/227

(Continued)

FOREIGN PATENT DOCUMENTS

CN 204523794 U 8/2015
CN 106180216 A 12/2016

(Continued)

OTHER PUBLICATIONS

Translation, JP 04-84616A, Nikaido et al. Mar. 1992.*

(Continued)

*Primary Examiner* — Edward T Tolan
(74) *Attorney, Agent, or Firm* — Maier & Maier, PLLC

(57) ABSTRACT

The invention relates to an intermediate stand guide (3) on a vertical roll stand (1) of a rolling line for guiding the rolled material into a horizontal roll stand (2) or out of a horizontal roll stand (2) having at least one guide element (4), which is mounted on the vertical roll stand (1) and is adjustable jointly with an adjustment movement of a vertical roll (6) assigned thereto and which follows the adjustment movement of the vertical roll (6), wherein the guide element (4) is arranged set back transversely to the rolling direction by a predefined offset dimension (X') to the edge of the vertical roll (6) engaged with the rolled material, wherein the guide element (4) is connected to a traverse (5) of the vertical roll (Continued)

stand (1) and the offset dimension (X') is pre-definable via an installation distance of the vertical roll (6) to the traverse (5) of the vertical roll stand (1).

17 Claims, 2 Drawing Sheets

(56) References Cited

U.S. PATENT DOCUMENTS

| | | | | | |
|---|---|---|---|---|---|
| 3,132,546 | A * | 5/1964 | Barr | B21B 39/14 | 72/227 |
| 3,712,095 | A * | 1/1973 | Dowsing | B21B 37/22 | 72/12.5 |
| 3,837,715 | A * | 9/1974 | Bock | F16C 13/006 | 384/13 |
| 4,790,164 | A * | 12/1988 | Rothe | B21B 39/165 | 226/177 |
| 8,627,699 | B2 * | 1/2014 | Eckelsbach | B21B 13/06 | 72/241.6 |
| 10,835,941 | B2 * | 11/2020 | Wendt | B21B 13/06 | |
| 2016/0160902 | A1 * | 6/2016 | Tamm | F16B 31/021 | 411/3 |

FOREIGN PATENT DOCUMENTS

| | | | |
|---|---|---|---|
| DE | 102006056317 | A1 | 6/2008 |
| EP | 1434658 | B1 | 2/2005 |
| GB | 445910 | A | 7/1986 |
| JP | 3238102 | A | 10/1991 |
| JP | 484616 | A | 3/1992 |
| JP | 8192203 | A | 7/1996 |
| JP | H105842 | A | 1/1998 |
| WO | 03033184 | A1 | 4/2003 |
| WO | 2010149192 | A1 | 12/2010 |

OTHER PUBLICATIONS

CN 110216156A, Shi et al. Sep. 2019.*
KR 100765042A, Youn Oct. 2007.*
KR 20090059633A, Lee Jun. 2009.*
JP 61-165218A, Okada et al. Jul. 1986.*
JP 59-87916A, Yoshikawa May 1984.*
KR 100428580B1, Korea Apr. 2004.*
JP 62-57705A, Kuwano et al. Mar. 1987.*
JP 03-219102A, Nikaido et al. Dec. 1991.*
Office Action issued on May 18, 2023, in corresponding Chinese Application No. 202080064323.0, 16 pages.
Office Action issued on Feb. 8, 2023, in corresponding Japanese Application No. 2022-511091, 4 pages.
International Search Report (with English Translation) and Written Opinion (with Machine Translation) issued on Dec. 10, 2020 in corresponding International Patent Application No. PCT/EP2020/074222; 17 pages.

* cited by examiner

INTERMEDIATE STAND GUIDE ON A VERTICAL ROLL STAND OF A MILL TRAIN, AND METHOD FOR GUIDING THE ROLLED STOCK USING THE INTERMEDIATE STAND GUIDE

FIELD

The invention relates to an intermediate stand guide on a vertical roll stand of a rolling line for guiding the rolled material having at least one guide element, which is mounted on the vertical roll stand and is adjustable jointly with an adjustment movement of a vertical roll and follows the adjustment movement of the vertical roll.

BACKGROUND

In hot strip lines, there are often combinations of horizontal roll stands with vertical roll stands connected upstream on the inlet side. The vertical roll stands are used to reduce the width of the rolled material to a required width and/or to take over strip guiding tasks, whereas the horizontal roll stands predominantly reduce the thickness of the rolled material.

Exact guiding of the rolled material, in particular the metal strip, is decisive in the design of the transitions between vertical roll stands and horizontal roll stands. In particular the ends of the metal strip require a corresponding guide on the inlet side of the horizontal roll stand.

A guide of the rolled material is also indispensable at transitions between a horizontal roll stand and a downstream vertical roll stand or in an arrangement of multiple vertical roll stands arranged in succession. Guiding the strip head is also often important in such cases.

A rolled material guiding device on a vertical roll stand having carriers of vertical guide plates for the rolled material, which are arranged on both sides of a vertical roll pair above the rollers of the roller track guiding the rolled material in or out and are displaceable, adjustable, and fixable transversely to the rolling direction is known from EP 1 434 658 B1, wherein the guide plates with their respective carriers follow the adjustment movement of the vertical roll and wherein the arrangement of the guide device is in front of or behind the rolls also enables a reversing operation of the roll stand without additional devices.

The carrier of the guide plates is connected on the rear to a linear positioning element of a mechanically or hydraulically driven displacement device arranged fixedly on the bearing body of the vertical roll. For the rolling operation, the guide plates assigned to the two vertical rolls are moved with the aid of a positioning key into positions corresponding to the width of the rolled material to be rolled and guide this rolled material during its entry into the rolling gap and subsequently during the further passage.

The above-described solution is subject to the disadvantage that an adjustment of the guide plates can only be carried out by personnel deployment in the machine. In addition, the guide plates known from EP 1 434 658 B1 only form a lateral guide of the rolled material. The tilting torques transmitted by the rolled material can only be absorbed to a restricted extent.

SUMMARY

The invention is based on the object of providing an intermediate stand guide of the type mentioned at the outset which is improved in this regard. The invention is based in particular on the object of providing an intermediate stand guide which enables simple, robust, and versatile guiding of the rolled material and which in particular enables a reliable adjustment of the offset dimension outside the machine or outside the vertical and/or horizontal roll stand.

According to one aspect of the invention, an intermediate stand guide is provided on a vertical roll stand of a rolling line for guiding the rolled material into a downstream horizontal roll stand and/or out of an upstream horizontal roll stand, which comprises at least one guide element, which is mounted on the vertical roll stand and is adjustable jointly with an adjustment movement of a vertical roll assigned thereto and which follows the adjustment movement of the vertical roll, wherein the guide element is arranged set back or set forward transversely to the rolling direction by a predefined offset dimension to the edge of the vertical roll engaged with the rolled material, wherein the guide element is connected to a traverse of the vertical roll stand and the offset dimension is pre-definable, inter alia, via an installation distance of the vertical roll to the traverse of the vertical roll stand.

A disadvantageous influence of the edging rolling process by undesired engagement of the guide element is prevented by a corresponding specification of the offset dimension. Nonetheless, the guide element has to be positioned sufficiently accurately in its location relative to the vertical roll/edger roll and follow its adjustment movement to fulfill its guide task. The permissible offset dimension can be between 0 to 100 mm, preferably between 10 to 80 mm, preferably between 15 to 70 mm, and particularly preferably between 20 to 60 mm.

Moreover, it can be advantageous if the guide element has an inlet bevel. This prevents the rolled material from inadvertently striking on an edge and possibly remaining hanging there.

The guide element of the intermediate stand guide according to the invention can be provided, for example, for guiding the rolled material out of or into a horizontal roll stand. At least one horizontal roll stand can be connected upstream and/or downstream of the vertical roll stand.

At least two guide elements are expediently provided, wherein each guide element is arranged set back by the predefined offset dimension with respect to a vertical roll and follows the adjustment movement of the assigned vertical roll in each case.

At least one guide element can be arranged in each case before and/or behind a vertical roll with respect to the rolling direction.

If at least two guide elements are provided, which are arranged on both sides of the vertical roll with respect to the rolling direction, a guide of the rolled material in and against the rolling direction is ensured, for example, if the vertical roll stand is arranged between two horizontal roll stands. The vertical roll stand can be provided both for reducing the width and for guiding the rolled material and also exclusively for guiding the rolled material.

The guide elements can be designed as angled guide bodies.

It is particularly preferably provided that the installation distance of the vertical roll relative to the guide element is predefined by means of one or more compensation plates of predefined thickness. This has the advantage in particular that the offset dimension can be set by means of one or more compensation plates of predefined thickness outside the machine or the roll stand. The compensation plates can either be tailored to the respective usage case or provided in corresponding gradations.

The adjustment movement of the vertical rolls is preferably effectuated via at least one adjustment device, for example, in the form of an adjusting cylinder, which acts on the traverse of the vertical roll stand. The traverse of the vertical roll stand in turn acts on chocks of the vertical rolls. The vertical rolls are typically mounted in such chocks.

Alternatively, the adjusting cylinder can act directly on the chocks of the vertical rolls.

The at least one compensation plate is preferably detachably connected to a chock accommodating the vertical roll. The adjustment of the offset dimension is generally required from time to time due to the wear of the vertical roll. The vertical rolls are typically replaced at regular intervals to rework the diameter of the roll because of the occurring wear. If one or more compensation plates having corresponding dimensions or corresponding thickness are connected to the relevant chocks of the vertical roll, it is easily possible to predefine the offset dimension by corresponding compensation plates fastened to the chock upon each roll change. In the installation position of the chock having the relevant vertical roll, the at least one compensation plate is then arranged between the traverse and the chock. The offset dimension is thus predefined because the relevant guide element is connected to the traverse of the vertical roll stand.

The guide element is preferably fastened to the traverse using an overload safeguard. At least one intended breakpoint or at least one other yielding fastening of the guide element on the traverse can be provided as the overload safeguard.

The guide element can be fastened, for example, by means of screws on the traverse of the relevant vertical roll stand, which are equipped with springs that break upon reaching a predetermined force. Alternatively, the screws can be provided with intended breakpoints.

In one expedient and advantageous variant of the intermediate stand guide according to the invention, the guide element is connected to the traverse of the vertical roll stand via a connecting part, preferably designed as a bar. The bar can be designed, for example, so that locking and unlocking with the traverse is preferably possible by means of a tool provided for this purpose, so that after unlocking it is possible to move the vertical roll independently of the intermediate stand guide, which is then stationary.

The fixing of the connecting part relative to the traverse can be made adjustable transversely to the rolling direction, so that in this way a further adjustability of the offset dimension X' can be provided. For example, multiple engagement locations for the connecting part can be provided on the traverse of the vertical stand. If the connecting part is designed as a bar, multiple receptacles for the bar can be provided on the traverse. Alternatively, making the fixing of the bar in the receptacle changeable by means of spacer parts, wedges, or the like can be provided. The bar itself could be made wedge-shaped or the overload safeguard is changed in location via spacer parts, for example, or the overload safeguard is exchanged with another overload safeguard having location-changed receptacle for the connecting part.

It is also advantageous if the connecting part is movable between the guide element and the traverse via a hydraulic actuating element, via which automatic locking and unlocking of the connecting part can take place. It can be provided here, for example, that the locking process and the unlocking process are monitored and regulated with the aid of sensors.

The movement and/or position of the guide element relative to the vertical roll can be monitored and regulated with the aid of sensors.

In one expedient variant of the intermediate guide stand according to the invention, it is provided that the guide element is mounted at least in one upper and/or lower guide bed of a vertical roll stand post. The guide element is preferably mounted in a sliding manner in the upper and/or lower guide bed of the vertical roll stand post, so that the guide element can execute a displacement transversely to the rolling direction with the assigned vertical roll.

In one particularly advantageous and expedient embodiment of the intermediate stand guide according to the invention, it is provided that the guide element has an upper and/or lower guide, preferably in the form of an upper and/or lower guide stop for the rolled material. This is advantageous in particular for guiding strip ends. The swarming of the strip or the strip bands is thus reliably prevented. For this purpose, the guide element can have an L-shaped or C-shaped guide profile. The horizontal and vertical guides formed in this way can be made replaceable or can be covered with replaceable wear elements, for example with wear plates. It is additionally possible to influence or adjust the offset dimension X' via wear plates extending laterally to the rolled material.

In a further embodiment of the intermediate stand guide according to the invention, it is provided that the guide element is supported at least on one side on a guide table. The guide table can be mounted, for example, in a horizontal roll stand post of the horizontal roll stand.

The guide element is preferably displaceably supported on the guide table via at least one plain bearing. Furthermore, it can be advantageous if the guide element additionally contains a safeguard against raising in the region of the guide table.

The guide element can have at least one detachable and thus replaceable wear plate.

A further aspect of the invention relates to a method for guiding the rolled material in a rolling line using an intermediate stand guide having one or more of the above-described features, wherein the offset dimension X' is set via a detected installation distance of the vertical roll or at least one vertical roll in relation to the traverse of the vertical roll stand.

The adjustment movement of at least one vertical roll of the vertical roll stand can be monitored by sensors to set and monitor the position of the vertical roll and/or the guide element. The displacement movement of the adjustment device can be monitored, for example, using limit switches, position transducers, pressure transducers, or the like.

Furthermore, it is advantageous if the movement and/or position of the guide element relative to the position of the vertical roll is also monitored.

The intermediate stand guide according to the invention can have means for detecting the wear of the vertical rolls and/or the guide bodies.

Furthermore, it is advantageous to incorporate the functionality of the intermediate stand guide with the aid of the sensors in the regulating processes of the machines or roll stands connected upstream and/or downstream, in order to be able to react to changed process conditions, for example, a change of the strip speed.

The wear of the vertical roll and/or the guide profiles is preferably detected by sensors and taken into consideration in the adjustment of the vertical roll and/or the guide element.

BRIEF DESCRIPTION OF THE FIGURES

The invention is explained hereinafter on the basis of an exemplary embodiment illustrated in the drawings.

In the figures.

DETAILED DESCRIPTION

Figure 1:
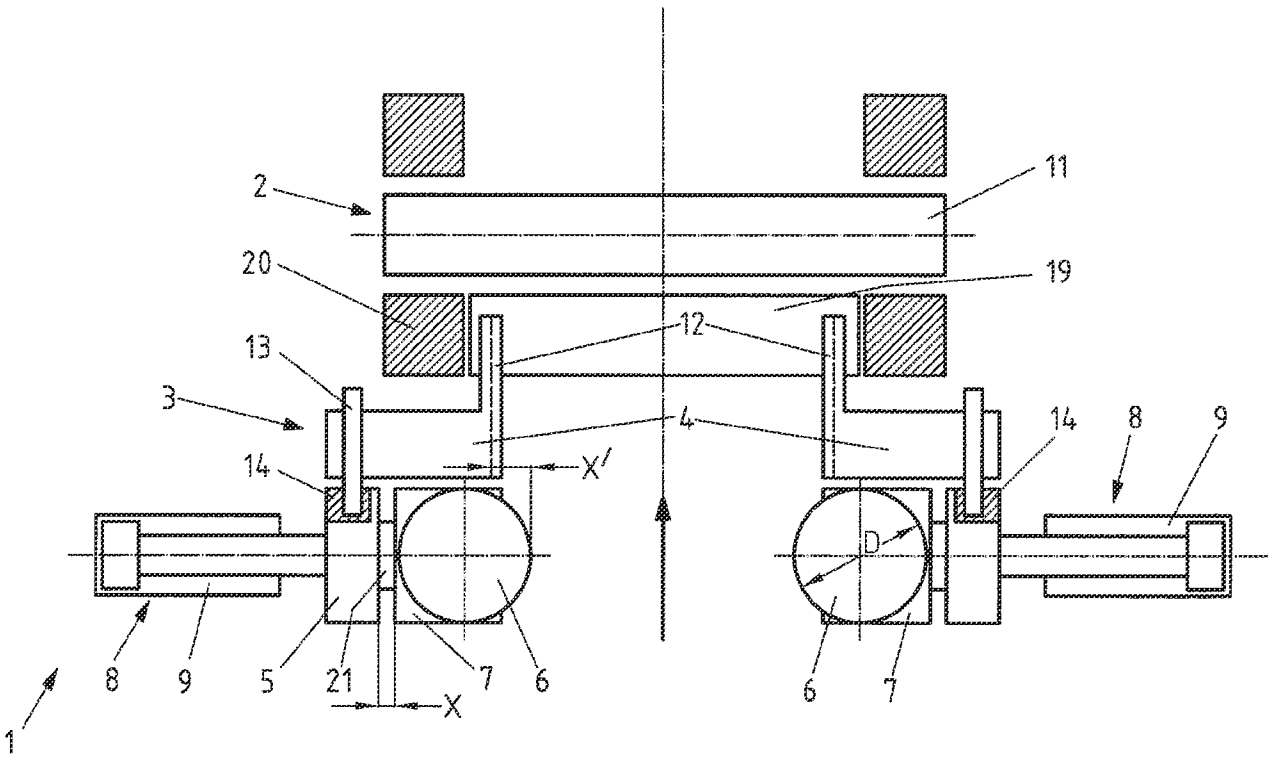
FIG. 1 shows a schematic top view of parts of a vertical roll stand having an intermediate stand guide according to the invention and a downstream horizontal roll stand, partially in section.

The figures show a part of a rolling line which is designed, for example, as a hot strip line. The rolling line comprises at least one vertical roll stand 1 and a horizontal roll stand 2 connected downstream in the rolling direction. The rolling direction is illustrated in each of the figures using an arrow. The vertical roll stand 1 is used in a known manner to reduce the width of the rolled material, for example in the form of a metal strip, whereas the horizontal roll stand 2 is used in a known manner to reduce the thickness of the rolled material. To guide the rolled material from the vertical roll stand 1 into the horizontal roll stand 2, an intermediate stand guide 3 is provided, which is fastened on the vertical roll stand 1 and effectuates a guide of the rolled material on the inlet side of the horizontal roll stand 2.

The intermediate stand guide 3 according to the invention comprises two guide elements 4, which are each fastened on a traverse 5 of the relevant vertical roll stand 1. The vertical roll stand 1 comprises a vertical roll stand post 15 and two traverses 5 mounted displaceably therein, on each of which a vertical roll 6 is held. The vertical rolls 6 are each mounted so they are rotatable and drivable in chocks 7. To regulate the clearance between the vertical rolls 6, the chocks 7 are each adjustable toward one another and away from one another using an adjustment device 8. The adjustment devices 8 each comprise at least one adjusting cylinder 9, to which a hydraulic pressure medium can be applied. The guide elements 4 are each arranged set back transversely to the rolling direction by an offset dimension X' in relation to the front edge of the vertical rolls 6, which is engaged with the rolled material in operation of the rolling line. This offset dimension X' is initially fixedly predefined. The guide elements 4 are fixedly connected to the respective traverse 5 and each follow the movement of the chocks 7 caused by the adjustment device 8 and thus the infeed movement of the vertical rolls 6.

The guide elements 4 are each connected using a connecting part 13 designed as a bar to the traverses 5 of the vertical roll stand post. An overload safeguard 14 is provided in each case in the region of the connection. The overload safeguard 14 is expediently designed so that it is either deliberately destroyed and/or is so yielding that the energy of the overload is deliberately changed. For example, a screw connection having intended breakpoints or a resiliently yielding screw connection can be provided as the overload safeguard 14. Furthermore, the guide elements 4 are mounted in a sliding manner in an upper and lower guide bed 16, 17 of the vertical roll stand post 15, which enable a displacement of the guide elements 4 transversely to the rolling direction and a corresponding support of the guide elements 4. The upper and the lower guide beds 16, 17 absorb the forces and torques occurring during the guiding of the rolled material. Both the upper and also the lower guide bed 16, 17 are provided with a corresponding lubrication, preferably with a grease lubrication.

Figure 2:
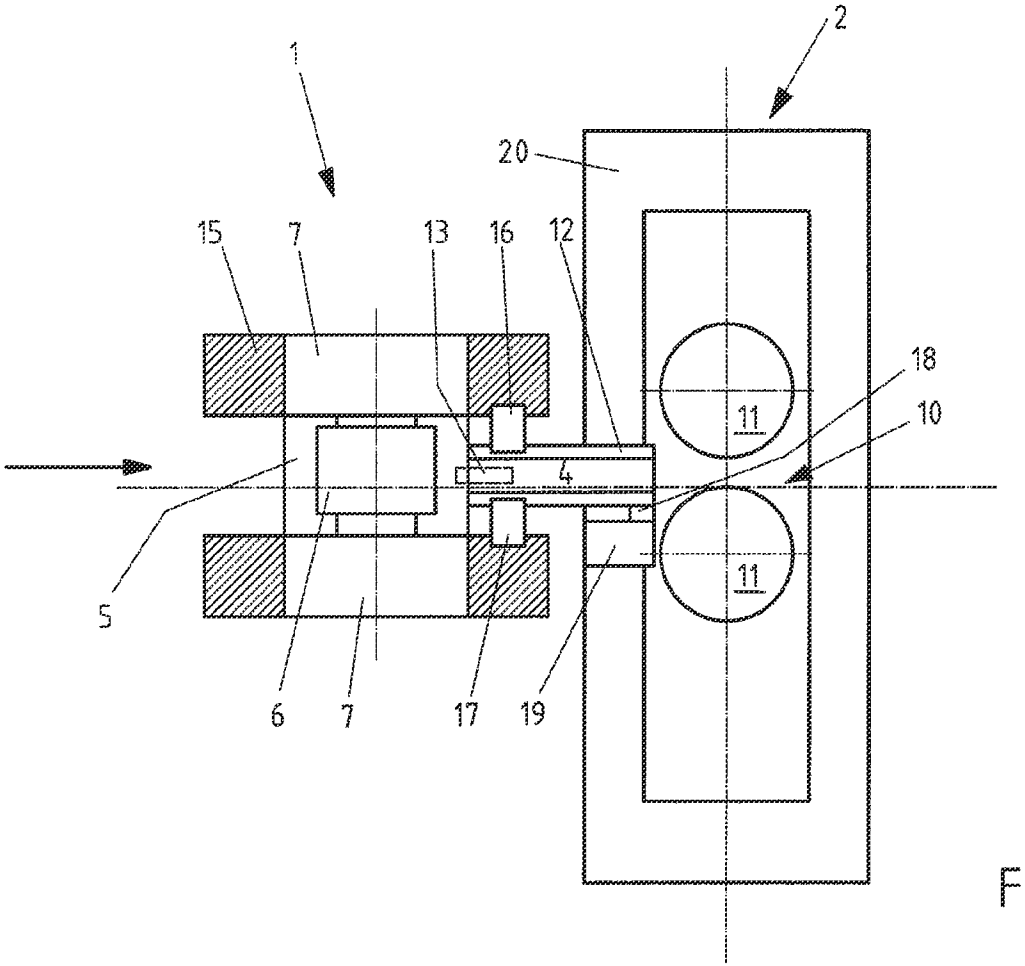
FIG. 2 shows a side view of the arrangement shown in FIG. 1.

The guide elements 4 are each used for laterally guiding the rolled material in the rolling gap 10 between horizontal rolls 11 of the horizontal roll stand 2 (see FIG. 2). The lateral guiding of the rolled material is reasonable and advantageous in particular for the ends of metal strips. To provide upper and lower guides for such guiding, the guide elements 4 are each provided with a C-shaped guide profile 12 on their side facing toward the rolled material transversely to the rolling direction.

On their ends facing toward the horizontal rolls 11 of the horizontal roll stand 2, the guide elements 4 are each supported via at least one plain bearing block 18 on a guide table 19, which is fastened on a horizontal roll stand post 20 of the horizontal roll stand 2. The guide table 19 is fastened and supported on the horizontal roll stand post 20 so that its guide surface is aligned below the upper edge of the lower horizontal roll 11.

To be able to predefine or set the offset dimension X', compensation plates 21 are fastened on each of the chocks 7, via which the distance X between the traverse 5 and the chock 7 is permanently pre-definable. Since the guide elements 4 are each preferably fixedly connected to the traverse 5 via the connecting parts 13, the distance X between the traverse 5 and the associated chock 7 determines the offset dimension X'. The displacement movement of the relevant vertical roll 6 is effectuated on each side of the rolled material via the adjustment device 8, which acts directly on the associated traverse 5 in each case. The traverse 5 in turn acts on the relevant chocks 7, which form a structural unit together with the vertical roll 6.

It is necessary at regular intervals to rework the vertical rolls 6 and the diameter D of the vertical rolls 6 due to wear. Without corresponding measures, the offset dimension X' from the front edge of the vertical roll 6 facing toward the rolled material to the relevant guide element 4 would change. It is possible by means of the compensation plates 21 provided on the chock 7 to set the offset dimension X' again upon each roll change by selecting the corresponding compensation plate 21.

LIST OF REFERENCE NUMERALS

1 vertical roll stand
2 horizontal roll stand
3 intermediate stand guide
4 guide elements
5 traverses
6 vertical rolls
7 chocks
8 adjustment devices
9 adjusting cylinder
10 rolling gap
11 horizontal rolls
12 guide profile
13 connecting parts
14 overload safeguards
15 vertical roll stand posts
16 upper guide bed of the vertical roll stand post
17 lower guide bed of the vertical roll stand post
18 plain bearing block
19 guide table
20 horizontal roll stand post
21 compensation plates
X thickness of the compensation plates
X' offset dimension
D diameter of the vertical rolls

The invention claimed is:

1. An intermediate stand guide on a vertical roll stand of a rolling line for guiding the rolled material using at least one guide element, which is mounted on the vertical roll stand and is adjustable jointly with an adjustment movement of a vertical roll assigned thereto and which follows the adjustment movement of the vertical roll, wherein the guide element is arranged set back transversely to the rolling direction by a predefined offset dimension to the edge of the vertical roll engaged with the rolled material, wherein the guide element is connected to a traverse of the vertical roll stand and the offset dimension is pre-definable via an installation distance of the vertical roll to the traverse of the vertical roll stand, and wherein the at least one guide element is connected to a horizontal roll stand in addition to being fastened to the vertical roll stand;

wherein the installation distance of the vertical roll to the traverse of the vertical roll stand is pre-definable by means of one or more compensation plates of pre-defined thickness;

wherein at least one compensation plate is detachably connected to a chock accommodating the vertical roll.

2. The intermediate stand guide as claimed in claim 1, wherein the guide element is fastened on the traverse using an overload safeguard.

3. The intermediate stand guide as claimed in claim 1, wherein at least one intended breakpoint and/or at least one other yielding fastening of the guide element is provided as an overload safeguard.

4. The intermediate stand guide as claimed in claim 1, wherein the guide element is connected to the traverse of the vertical roll stand via a connecting part.

5. The intermediate stand guide as claimed in claim 4, wherein the fixing of the connecting part relative to the traverse is made adjustable transversely to the rolling direction.

6. The intermediate stand guide as claimed in claim 1, wherein the guide element is mounted at least in one upper and/or lower guide bed of a vertical roll stand post of the vertical roll stand.

7. The intermediate stand guide as claimed in claim 6, wherein the guide element is mounted in a sliding manner in the upper and/or lower guide bed of the vertical roll stand post.

8. The intermediate stand guide as claimed in claim 1, wherein the position of the guide element is adjustable relative to the vertical roll.

9. The intermediate stand guide as claimed in claim 1, wherein the guide element has an L-shaped or C-shaped guide profile.

10. The intermediate stand guide as claimed in claim 1, wherein the guide element is supported at least on one side on a guide table.

11. The intermediate stand guide as claimed in claim 10, wherein the guide element is supported via at least one plain bearing so it is displaceable on the guide table.

12. The intermediate stand guide as claimed in claim 1, wherein the guide element has at least one replaceable wear plate.

13. A method for guiding the rolled material in a rolling line using an intermediate stand guide as claimed in claim 1, wherein the offset dimension is set via a detected installation distance of the vertical roll to the traverse of the vertical roll stand.

14. The method as claimed in claim 13, wherein the adjustment movement of at least one vertical roll of the vertical roll stand is monitored by sensors to set and monitor the position of the vertical roll and/or the guide element.

15. The method as claimed in claim 1, wherein the movement and/or position of the guide element is monitored relative to the position of the vertical roll.

16. The method as claimed in claim 1, wherein wear of the vertical roll and/or the guide profiles is detected by sensors and taken into consideration in the adjustment of the vertical roll and/or the guide elements.

17. The intermediate stand guide as claimed in claim 1, wherein the position of the guide element is hydraulically adjustable relative to the vertical roll, and wherein the guide element is supported at least on one side on a guide table mounted on a horizontal roll stand post of the horizontal roll stand.

* * * * *